US006896030B2

(12) United States Patent
Soderstrom et al.

(10) Patent No.: US 6,896,030 B2
(45) Date of Patent: May 24, 2005

(54) DIRECTIONAL SOLIDIFICATION METHOD AND APPARATUS

(75) Inventors: Mark L. Soderstrom, Fruitport, MI (US); Bradley Donaldson, Zeeland, MI (US); John R. Brinegar, Muskegon, MI (US)

(73) Assignee: Howmet Corporation, Cleveland, OH (US)

( * ) Notice: Subject to any disclaimer, the term of this patent is extended or adjusted under 35 U.S.C. 154(b) by 0 days.

(21) Appl. No.: 10/630,224

(22) Filed: Jul. 30, 2003

(65) Prior Publication Data

US 2005/0022959 A1 Feb. 3, 2005

(51) Int. Cl.[7] ..... B22D 25/00; B22D 27/04

(52) U.S. Cl. ..... 164/122.1; 164/122.2; 164/338.1

(58) Field of Search ..... 164/122.1, 122.2, 164/338.1

(56) References Cited

U.S. PATENT DOCUMENTS

| | | | | |
|---|---|---|---|---|
| 3,714,977 | A | 2/1973 | Terkelsen | |
| 3,810,504 | A | 5/1974 | Piwonka | |
| 3,841,384 | A | 10/1974 | Tingquist et al. | |
| 3,897,815 | A | 8/1975 | Smashey | 164/127 |
| 4,108,236 | A | 8/1978 | Salkeld | 164/388 R |
| 4,178,986 | A | 12/1979 | Smashey | 164/251 |
| 4,213,497 | A | 7/1980 | Sawyer | |
| 4,763,716 | A | 8/1988 | Graham et al. | 164/122.1 |
| 4,819,709 | A | 4/1989 | Lallement | 164/154 |
| 5,168,916 | A | 12/1992 | Doriath et al. | 164/338.1 |
| 5,429,176 | A | 7/1995 | Atkinson et al. | 164/412 |
| 5,778,961 | A | 7/1998 | Hugo et al. | 164/122.1 |
| 5,841,669 | A | 11/1998 | Purvis et al. | 364/554 |
| 5,921,310 | A | 7/1999 | Kats et al. | 164/61 |
| 5,988,257 | A | 11/1999 | Hugo | 164/122.1 |
| 6,085,827 | A | 7/2000 | Hugo | 164/122.1 |
| 6,276,432 | B1 | 8/2001 | Thompson et al. | 164/122.1 |
| 6,311,760 | B1 | 11/2001 | Fernihough et al. | 164/122.1 |
| 6,378,835 | B1 | 4/2002 | Wakita et al. | 249/78 |
| 6,698,493 | B2 * | 3/2004 | Graham | 164/122.1 |
| 2001/0018960 | A1 | 9/2001 | Thompson et al. | 164/122.1 |

FOREIGN PATENT DOCUMENTS

| | | |
|---|---|---|
| EP | 0 278 762 | 8/1988 |
| EP | 1 162 016 | 12/2001 |
| WO | WO 99/12679 | 3/1999 |

OTHER PUBLICATIONS

Ametek Brochure for Hunter Spring Products; Sellersville, Pennsylvania; 1999; pp. 3-12.

* cited by examiner

*Primary Examiner*—Kuang Y. Lin
(74) *Attorney, Agent, or Firm*—Gary P. Topolosky; Eckert Seamans Cherin & Mellott, LLC

(57) ABSTRACT

Apparatus and method for DS casting using one or more thermal baffle members positionable at a lower open end of a directional solidification casting furnace by movement of a ram on which a mold to be cast is moved relative to the casting furnace. A unique thermal baffle member can be used for each particular series or run of molds to be cast.

18 Claims, 8 Drawing Sheets

DIRECTIONAL SOLIDIFICATION METHOD AND APPARATUS

BACKGROUND OF THE INVENTION

The present invention relates to directional solidification apparatus and processes wherein heat is removed unidirectional from a melt in a mold to form a columnar grain or single casting.

BACKGROUND OF THE INVENTION

In the manufacture of components, such as nickel base superalloy turbine blades and vanes, for gas turbine engines, directional solidification (DS) investment casting techniques have been employed in the past to produce columnar grain and single crystal casting microstructures having improved mechanical properties at high temperatures encountered in the turbine section of the engine.

In the manufacture of turbine blades and vanes using the well known DS casting "withdrawal" technique where a melt-filled investment mold residing on a chill plate is withdrawn from a casting furnace, a stationary thermal baffle has been used proximate the bottom of the casting furnace to improve the unidirectional thermal gradient present in the molten metal or alloy as the investment mold is withdrawn from the casting furnace. The baffle reduces heat loss by radiation from the furnace and the melt-filled mold as the mold is withdrawn form the casting furnace.

When a new series or run of molds is to be cast having a different exterior shape, past practice has involved shutting down the casting furnace, cooling the casting furnace to ambient temperature, and disassembling the furnace to the extent necessary to replace the thermal baffle with a different thermal baffle designed to better accommodate the new mold shape to be cast. This is disadvantageous in a high volume production environment in that labor, time and cost of making cast components are increased.

In attempts to improve the thermal gradient, various baffle constructions have been proposed such as, for example, described in U.S. Pat. No. 3,714,977 where a movable upper baffle and fixed lower baffle are used and in U.S. Pat. No. 4,108,236 where a fixed baffle and a floating baffle below the fixed baffle and floating on a liquid coolant bath disposed below the furnace are used.

U.S. Pat. No. 5,429,176 discloses a cloth-like baffle that has a slit or other opening with peripheral edges that engage the melt-filled mold during withdrawal from the furnace.

U.S. Pat. No. 4,819,709 discloses first and second opposing, movable heat shields having overlapping regions that define an aperture through which the melt-filled mold is withdrawn. The heat shields are movable toward or way from one another in a horizontal plane.

Howmet U.S. Pat. No. 6,276,432 (MP-205) discloses use of multiple radiation baffles wherein one radiation baffle is fixed at a lower end of the casting furnace and another radiation baffle follows the hot melt-filled mold as it is withdrawn from the casting furnace.

SUMMARY OF THE INVENTION

The present invention provides apparatus as well as method for DS casting using a thermal baffle member positionable at a lower open end of a DS casting furnace by movement of a ram on which a mold to be cast is moved relative to the casting furnace. A unique thermal baffle member can be used for each particular shape of a series or run of molds to be cast. During DS casting, the thermal baffle member is maintained at a first operative position at the lower end of the heated casting furnace. The thermal baffle member can be moved away from the casting furnace to a second position remote from the lower end of the casting furnace where at that position, the thermal baffle member can be readily replaced with another thermal baffle member having a baffle opening unique to another shape of a series or run of molds to be cast. Replacement of the thermal baffle member can be achieved without having to cool down and disassemble the casting furnace to effect baffle replacement. Thermal shielding action between the hot casting furnace and a cooling region located below the casting furnace is thereby optimized for each particular shape of a series or run of mold(s) to be cast.

Directional solidification casting apparatus pursuant to the invention comprises a casting furnace having an open lower end through which a mold disposed on a chill member is moved by a ram, a thermal baffle member supported on the ram and positionable at the lower end of the casting furnace by movement of the ram toward the casting furnace, and spring means for retaining the thermal baffle member at the lower end as the ram positions the mold in the casting furnace and as the ram withdraws the mold filled with molten metallic material away from the casting furnace for directional solidification of the molten metallic material in the mold. A plurality of thermal baffle members may be employed each being positionable at the lower end of the casting furnace by movement of the ram toward the casting furnace and each having spring means for retaining the thermal baffle member at the lower end as the ram positions the mold in the casting furnace and as the ram withdraws the mold filled with molten metallic material away from the casting furnace for directional solidification of the molten metallic material in the mold.

Pursuant to an illustrative embodiment of the invention, a thermal baffle system is disposed on a ram that carries a chill member on which the mold is disposed. The thermal baffle system includes a support member disposed on the ram for movement therewith as the mold is placed in and then withdrawn from the casting furnace. A plurality of upstanding support elements are disposed on the support member and support proximate their upper ends a thermal baffle member having a mold opening. At least one, preferably a plurality, of coil springs are disposed on the underside of the chill member. In particular, each coil spring has a housing fixed on the underside of the chill member and a movable coil spring element having one end connected to the housing another end that is connected to the support member attached to the ram.

In operation, the ram is initially raised to place the thermal baffle member against the lower end of the casting furnace and then further raised to pass the mold through the baffle opening and into the casting furnace where a molten metallic material (melt) is provided in the mold. As the melt-filled mold is placed in the casting furnace, the coil springs are uncoiled or extended out of the respective housing to exert a spring force in a direction toward the lower end of the casting furnace so as to bias and retain the thermal baffle member against the lower end. When the melt-filled mold is withdrawn from the casting furnace by lowering of the ram, the coil springs continue to bias and retain the thermal baffle member against the lower end of the casting furnace as the springs are coiled or retracted back into the respective housing. The thermal baffle member is biased against the lower end of the casting furnace until the coil springs are fully retracted, at which time further lowering of the ram will disengage the thermal baffle member from the lower end of the casting furnace.

Multiple thermal baffle members and associated support elements and coil springs of the type described above may be employed to provide a multi-stage thermal baffle system for the directional solidification of molten metallic material in a mold.

DETAILED DESCRIPTION OF THE INVENTION

Figure 1:
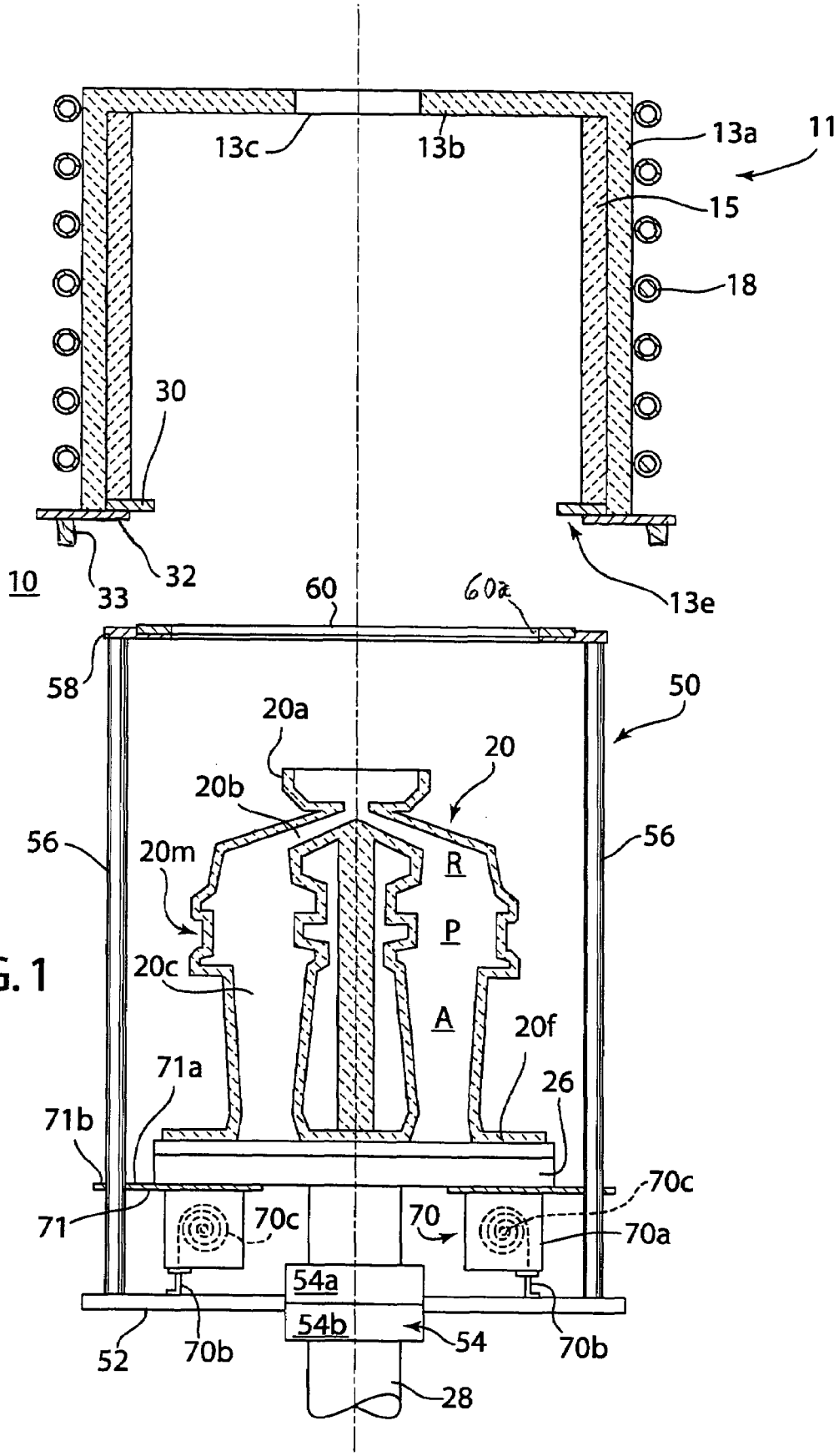
FIG. 1 is a schematic cross-sectional view of a DS casting apparatus showing a thermal baffle system in accordance with an embodiment of the invention at a position remote from the casting furnace.

The present invention provides in one embodiment a spring-biased thermal baffle system for use in well known DS withdrawal casting apparatus and processes and is especially useful, although not limited, to casting nickel, cobalt and iron base superalloys to produce a columnar grain or single cast microstructure. Referring to FIG. 1, casting apparatus in accordance with an embodiment of the invention for DS casting nickel, cobalt and iron base superalloys to produce columnar grain or single cast microstructure includes a vacuum casting chamber 10 having a casting furnace 11 disposed therein in conventional manner. Thermal insulation members 13*a*, 13*b* form a furnace enclosure with an open lower end 13*e*. Positioned within the tubular thermal insulation member 13*a* is an inner solid graphite tubular member 15 forming a susceptor that is heated by energization of the induction coil 18. The thermal insulation member 13*b* includes an aperture 13*c* through which molten metal or alloy, such as a molten superalloy, can be introduced into the mold 20 from a crucible (not shown) residing in the chamber 10 above the casting furnace 11 in conventional manner.

An induction coil 18 is supported adjacent the thermal insulation member 13*a* and is energized by a conventional electrical power source (not shown). The induction coil 18 heats tubular graphite susceptor 15 disposed interiorly thereof. After the empty mold 20 is positioned in the furnace 12, the mold is preheated to a suitable casting temperature to receive the melt by the heat from the susceptor 15.

The mold 20 typically comprises a conventional ceramic investment shell mold formed by the well know lost wax process. The mold 20 is shown as gang or cluster ceramic investment shell mold having a pour cup 20*a*, runners 20*b*, and a plurality (2 shown) of shell molds 20*m* each having a mold cavity 20*c* replicating the shape of the article to be cast. Mold cavities 20*c* each are shown having the shape of inverted gas turbine engine blade having a root region R at the top, a platform region P and an airfoil region A at the bottom.

Pour cup 20*a* receives molten metallic material (melt) from a crucible (not shown) disposed above the casting furnace. The pour cup 20*a* communicates via runners 20*b* to one or more mold cavities 20*c* in the mold. Each mold cavity 20*c* communicates to a chill member 26, such as a chill plate, at an open bottom end of each mold cavity 20*c* in conventional manner to provide unidirectional heat removal from the melt residing in the mold and thus a thermal gradient in the melt in the mold extending along the longitudinal axis of the mold. In casting single crystal components, a crystal selector (not shown), such as pigtail, will be incorporated into the mold above the open lower end thereof to select a single crystal for propagation through the melt, all as is well known. The mold 20 is formed with an integral mold base 20*f* that rests on the chill member 26 as shown and that can be clamped thereto in conventional manner if desired. The chill member 26 resides on a ram 28 raised and lowered by a fluid actuator (not shown) in conventional manner.

A first fixed annular furnace support ring 30 is positioned at the open lower end 13*e* of the casting furnace on a second fixed annular support ring 32, which in turn is disposed on legs 33 (partially shown) in the vacuum chamber 10. Support ring 30 is made of graphite foam or other suitable material. Support ring 32 is made of copper or other suitable material.

Figure 2:
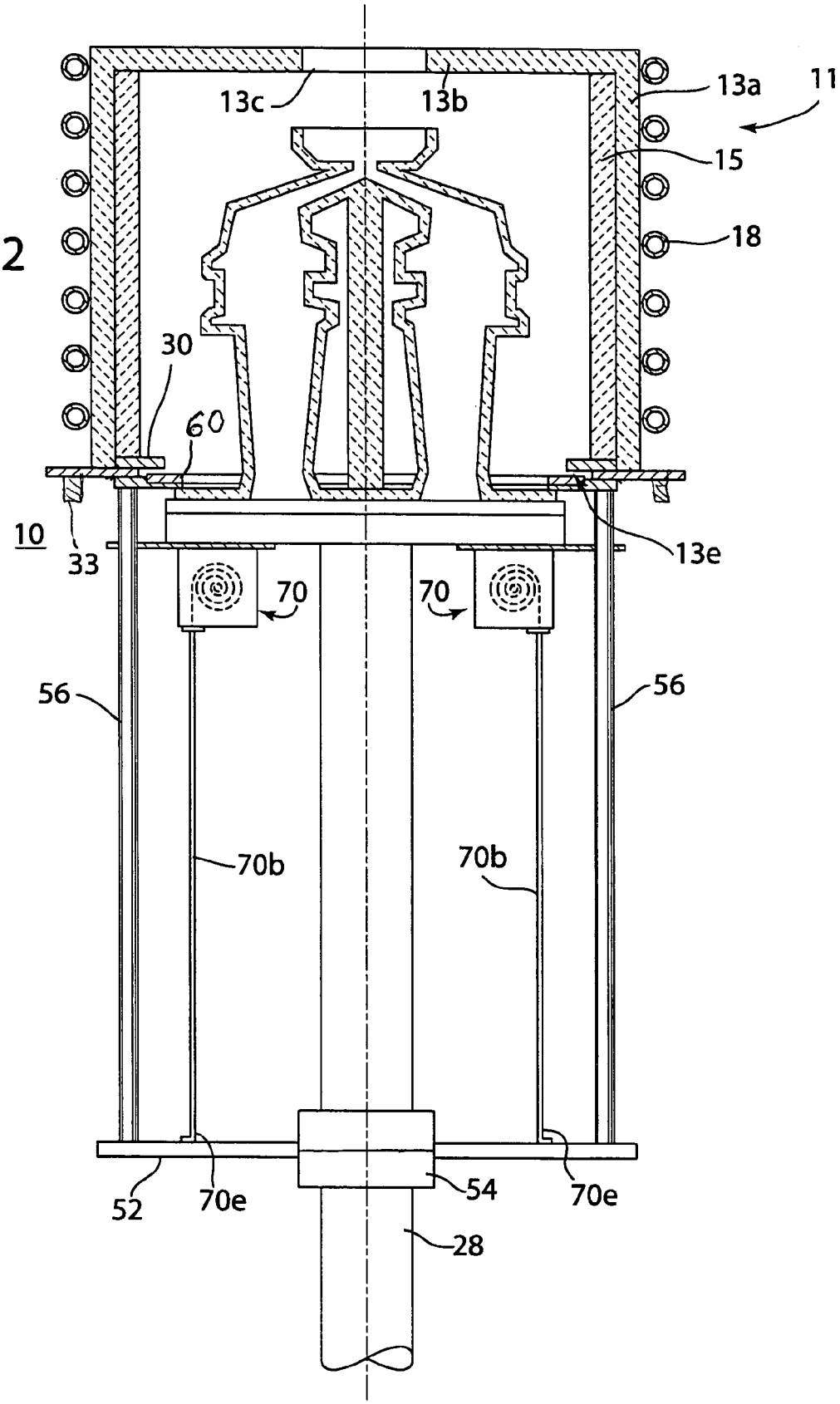
FIG. 2 is similar to FIG. 1 but with the thermal baffle system in accordance with an embodiment of the invention at a position proximate the casting furnace.
Figure 3:
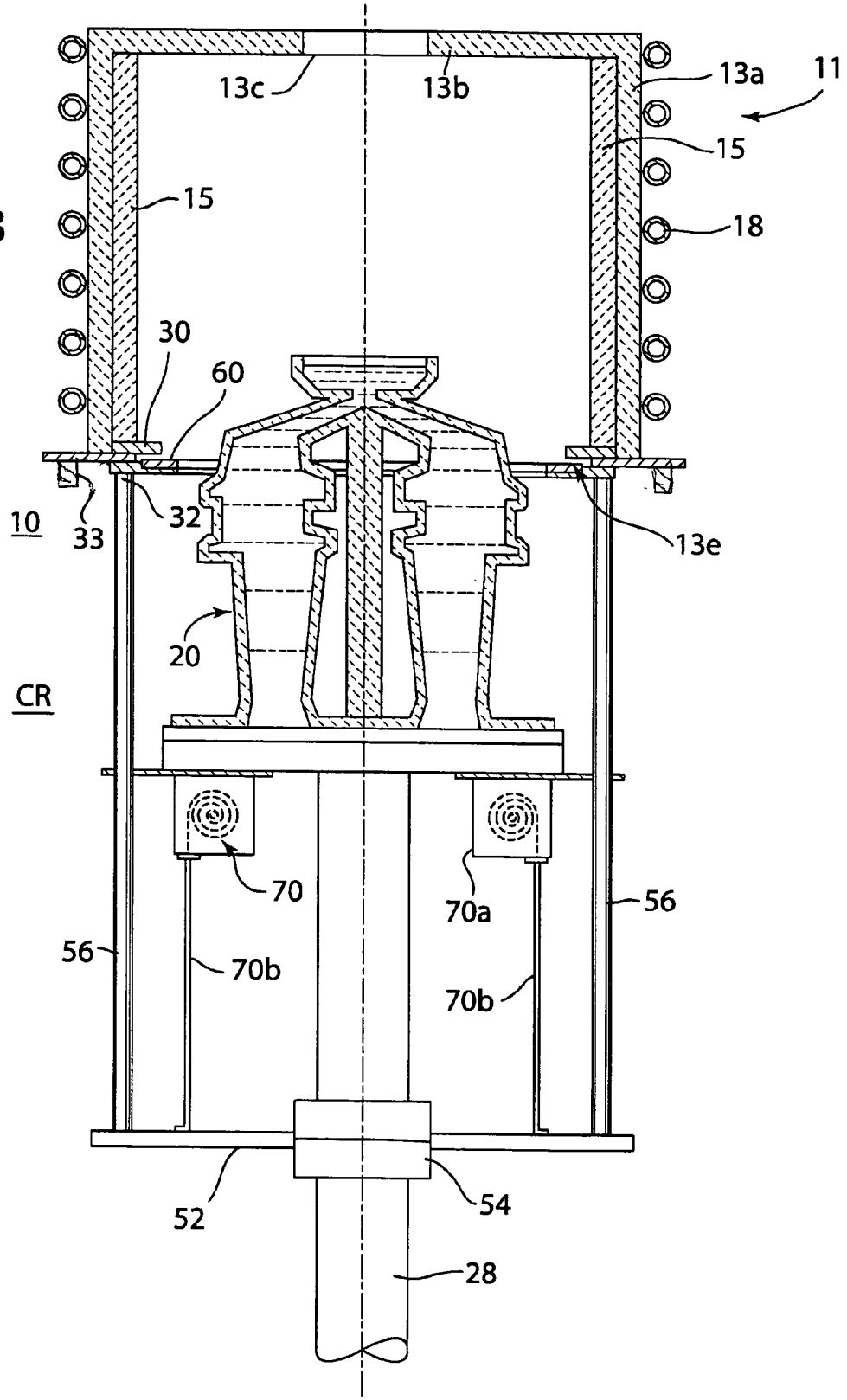
FIG. 3 is similar to FIG. 2 with the melt-filled mold being withdrawn from the casting furnace.
Figure 4:
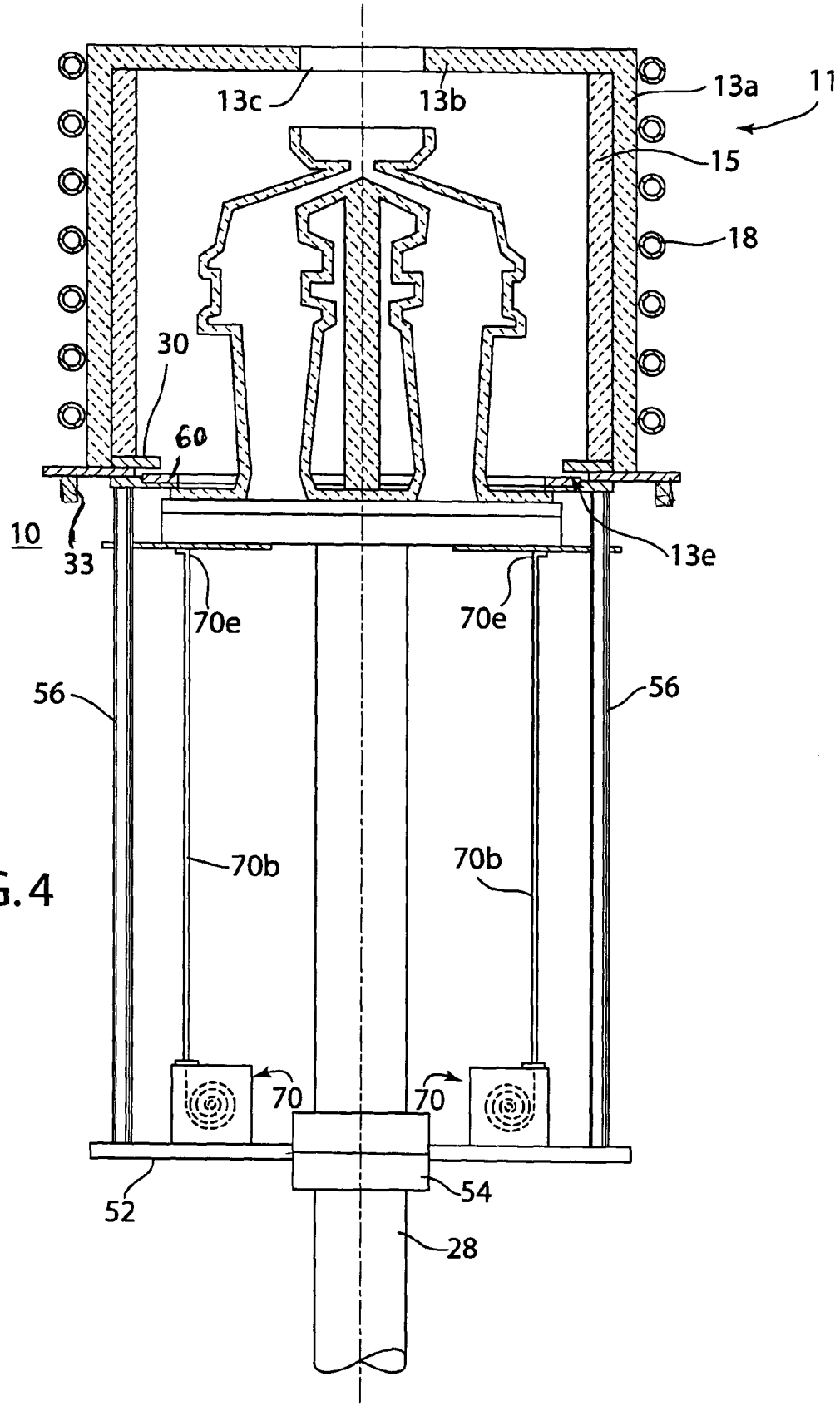
FIG. 4 a schematic cross-sectional view of a DS casting apparatus showing a thermal baffle system in accordance with an another embodiment of the invention at a position proximate the casting furnace.

In accordance with an illustrative embodiment of the invention, a spring-biased thermal baffle system 50 is disposed on ram 28 that carries chill member 26 on which the mold 20 is disposed as shown in FIGS. 1–3. The thermal baffle system includes a support member 52 illustrated as a flat plate disposed and fastened on a mounting collar 54 affixed on the ram 28. The collar 54 includes a central passage that allows the ram 28 to freely move through the collar 54 as the mold 20 is placed in and then withdrawn from the casting furnace 11. The mounting collar 54 includes upper and lower collar sections 54*a*, 54*b* between which the inner periphery of the support member 52 is fastened.

The support member 52 includes a plurality of upstanding support elements 56, such as rods, having lower ends fastened thereon (e.g. by threading into holes in support member 52) and having upper ends fastened in similar manner to an annular baffle support ring 58, which may be made of stainless steel or other heat resistant material. The support ring 58 applies uniform bias or force on the thermal baffle member to hold it against the support ring 30. The support elements 56 can be spaced about the periphery of the support member 52 and support ring 58. Three, four or more support elements 56 can be used between the support member 52 and support ring 58. The support elements 56 can be made of stainless steel or other heat resistant material.

An annular thermal baffle member 60 is disposed on the support ring 58 and includes an opening 60*a* through which the mold 20 passes. The thermal baffle member 60 is held on support ring 58 by any suitable fastening means such as sheet metal fasteners, pins, and other suitable fasteners. The opening 60*a* is designed fit as snugly as possible the exterior peripheral walls of the mold 20 as it is withdrawn from the casting furnace 11 to reduce heat loss from the casting furnace 11 to the cooling region CR below the lower end 13*e* of the casting furnace. The thermal baffle member 60 can be made of graphite foam, graphite felt or other suitable high temperature thermal insulation material.

One or more coil springs 70 are disposed on the underside of the chill member 26. For purposes of illustration and not limitation, four coil springs 70 can be spaced periphery apart on the underside of the chill member 26. The springs 70 can comprise prestressed spiral springs, constant torque springs, and other suitable coil springs. In particular, each coil spring 70 has a housing 70*a* fastened on the underside of the chill member and a movable flat coil spring element 70*b* having one end affixed on an arbor 70*c* mounted on the housing 70*a*. The housings 70*a* are disposed on an annular guide plate 71 having peripheral flange 71*a* with openings 71*b* receiving the support elements 56 to guide movement of the chill member 26.

The other end of coil spring element 70*b* is connected to the support member 52, which is attached to the ram. As the spring element 70*b* is uncoiled out of the housing 70*a*, a spring force is exerted on the support member 52. The end 70*e* of the coil spring element 70 can be fastened to support member 52 by any suitable fastener, such as for example a bolt, screw or the like. Suitable coil springs 70 are available from Ametek Hunter Company, 900 Clymer Ave., Sellersville, Pa. 18960.

In operation, the mold 20 typically is preheated to a suitable casting temperature before being placed on the chill member 26 at a position remote from the casting furnace 11 as illustrated in FIG. 1. The ram 28 then is initially raised to place the thermal baffle member 60 close to the support rings 30, 32 of the lower end 13*e* of the casting furnace 11 and then further raised to pass the empty mold 20 through the baffle opening 60*a* and into the casting furnace 11. In particular, as the ram is raised, the support ring 58 engages the second furnace support ring 32 under the casting furnace 11 to serve as a stop for the support ring 58 and to position the thermal baffle member 60 proximate to furnace support ring 30, FIG. 2. Coil spring elements 70*b* exert an upward bias on the collar 54, support elements 56 and support ring 58 and thus thermal baffle member 60 at this point.

The ram 28 is raised further relative to the stopped thermal baffle member 60 to position the pre-heated mold 20 in the casting furnace 11 where a molten metallic material (melt) is poured into the pour cup 20*a* of the mold 20 from the crucible thereabove. Alternately, the pour cup 20*a* can contain a solid charge that is melted in the casting furnace by energization of susceptor 15 to provide the melt therein. The melt flows through runners 20*b* into the mold cavities 20*c* to fill them with the melt.

As shown in FIG. 2, the coil spring elements 70*b* are uncoiled or extended out of the respective housing 70*a* to exert a spring tension force in an upward direction (toward the lower end 13*e*) that biases and retains the support ring 58 for thermal baffle member 60 upwardly against the support ring 32 at the lower end 13*e* of the casting furnace as the ram 28 is raised further relative to the thermal baffle member 60 and its support components including support member 52, support elements 56 and support ring 58. This spring bias holds the support ring 58 for thermal baffle member 60 tightly against the support ring 30 of the lower end 13*e* of the casting furnace.

When the melt-filled mold 20 is withdrawn from the casting furnace by lowering of the ram 28 to effect directional solidification of the melt, the coil spring elements 70*b* continue to bias and retain the support ring 58 for thermal baffle member 60 against the support ring 30 of the lower end of the casting furnace as they are coiled or retracted back into the respective housing 70*a*. Coil spring elements 70*b* continue to exert an upward bias on the collar 54, support elements 56 and support ring 58 and thus thermal baffle member 60 during mold withdrawal.

The thermal baffle member 60 is biased and retained at the lower end of the casting furnace as the ram is lowered until the coil spring elements are fully retracted, at which time further lowering of the ram 28 will disengage the thermal baffle member 60 from the lower end of the casting furnace to the position shown in FIG. 1. The ram 28 is lowered to move the thermal baffle member 60 and its supporting components to the remote position relative to the lower end of the casting furnace as shown in FIG. 1.

At this remote position, the thermal baffle member also can removed and replaced if a series or run of molds 20 having a different exterior shape are to be cast next. In particular, a new thermal baffle member unique to the new mold exterior shape is fastened on the support ring 58 for use in casting the next series or run of molds. The thermal baffle member 60 can be readily replaced with another thermal baffle member between each run of molds without having to cool down and disassemble the casting furnace to effect thermal baffle replacement. The new thermal baffle member would have an opening 60*a* optimized in shape for the new exterior shape of the next series or run of molds to be cast. Thermal shielding action between the hot casting furnace 11 and cooling region CR below the casting furnace is thereby optimized for each particular shape of one or series or run of mold(s) to be cast.

Also, at this remote position, the thermal baffle member 60 may be inspected for damage and replaced if necessary.

The invention envisions placing a position sensor (not shown) proximate one or more the coil spring elements 70*b* in a manner to sense their position to provide feedback data as to location and movement of the spring elements.

The invention also envisions using more than one thermal baffle member 60 and its supporting components described above. For example, second and third thermal baffle members can be provided and supported about the ram 28 by supporting components described above that would be circumferentially offset relative to one another about the ram to allow multiple thermal baffle members to be positioned at the lower end 13*e* of the casting furnace 11.

Figure 5:
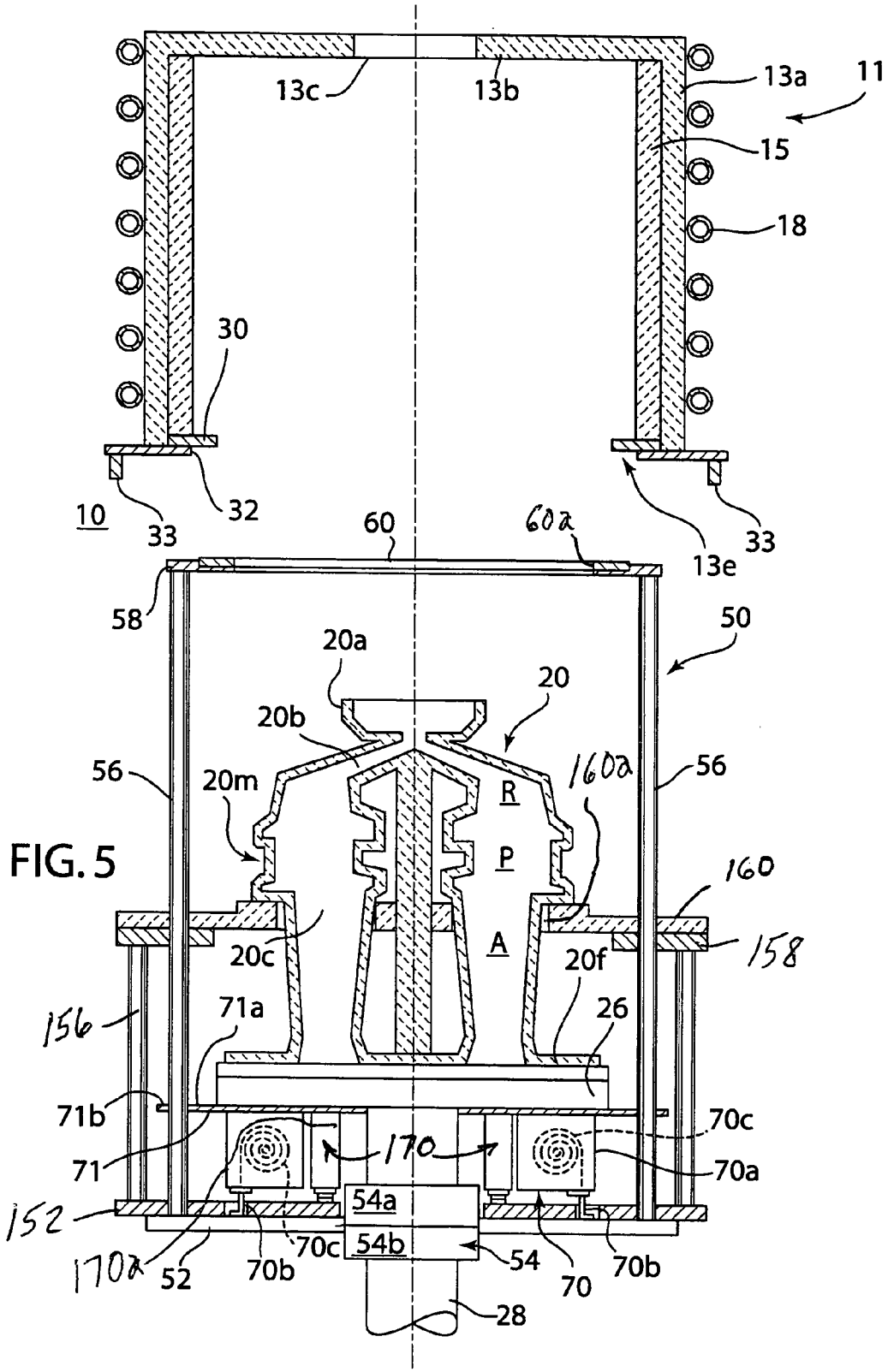
FIG. 5 is a schematic cross-sectional view of a DS casting apparatus of still another embodiment of the invention showing a multi-stage thermal baffle system in accordance with the invention with the mold positioned remote from the casting furnace.
Figure 6:
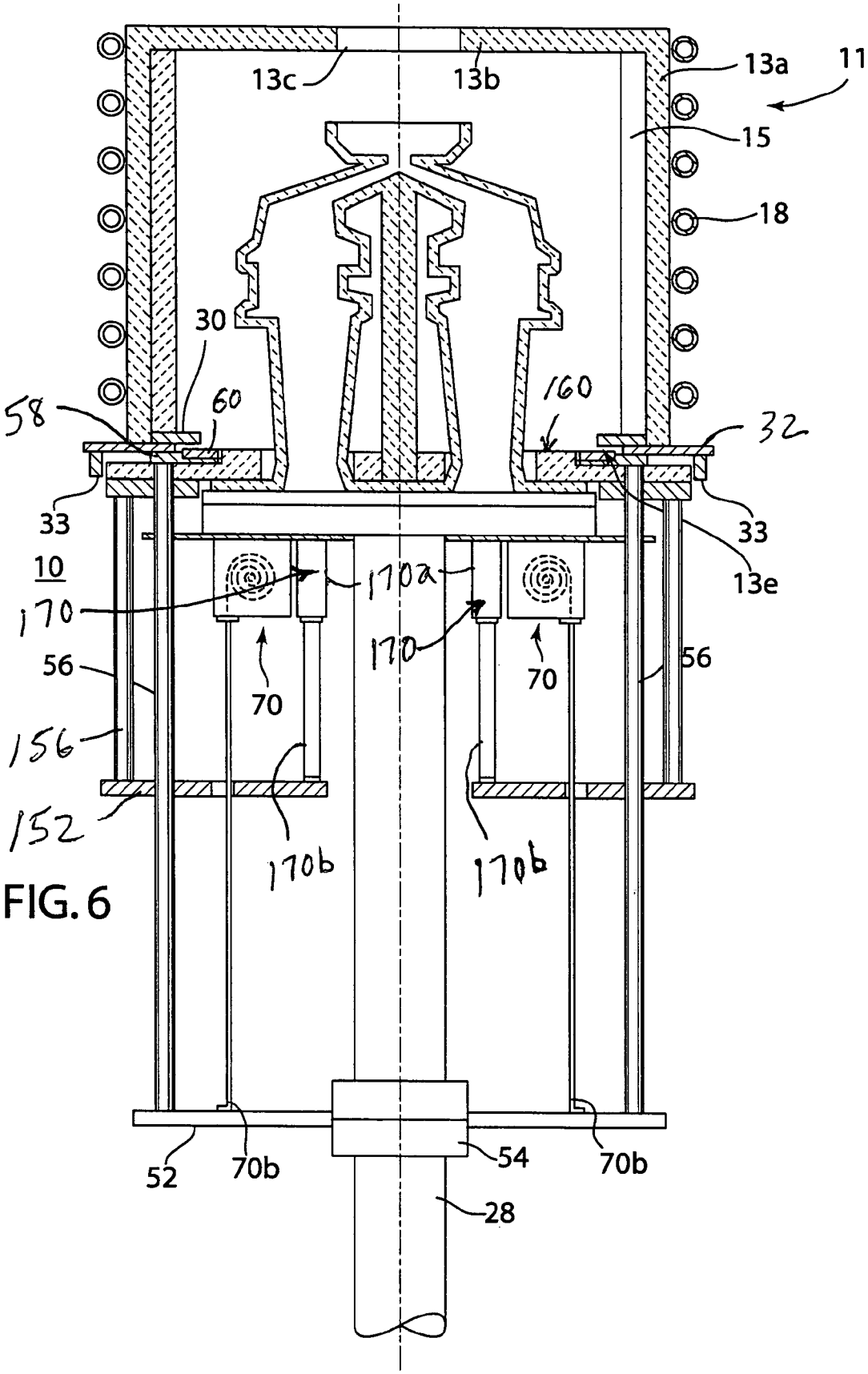
FIG. 6 is similar to FIG. 5 but with the thermal baffle system in accordance with an embodiment of the invention at a position proximate the casting furnace.
Figure 7:
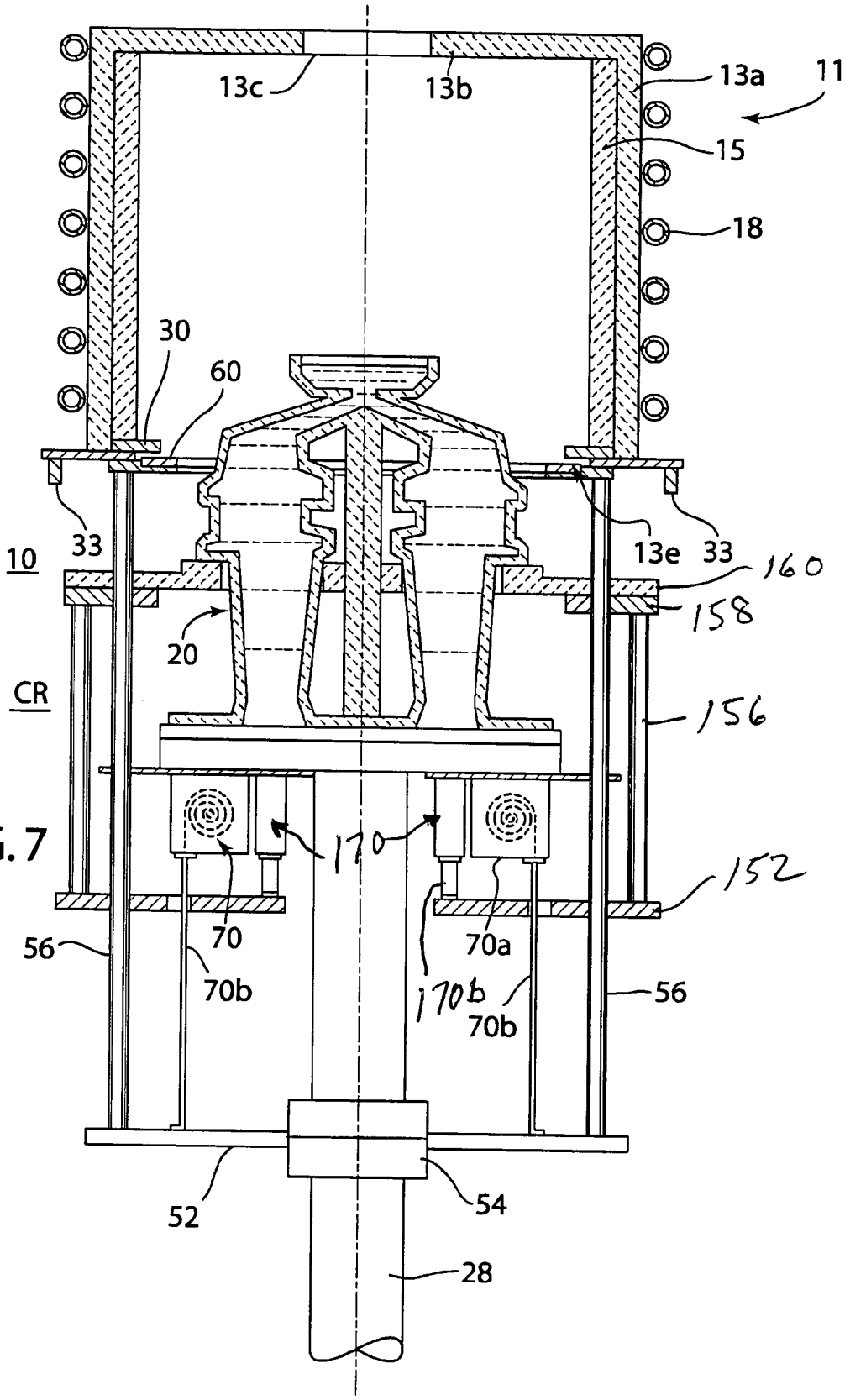
FIG. 7 is similar to FIG. 6 with the melt-filled mold being withdrawn from the casting furnace.
Figure 8:
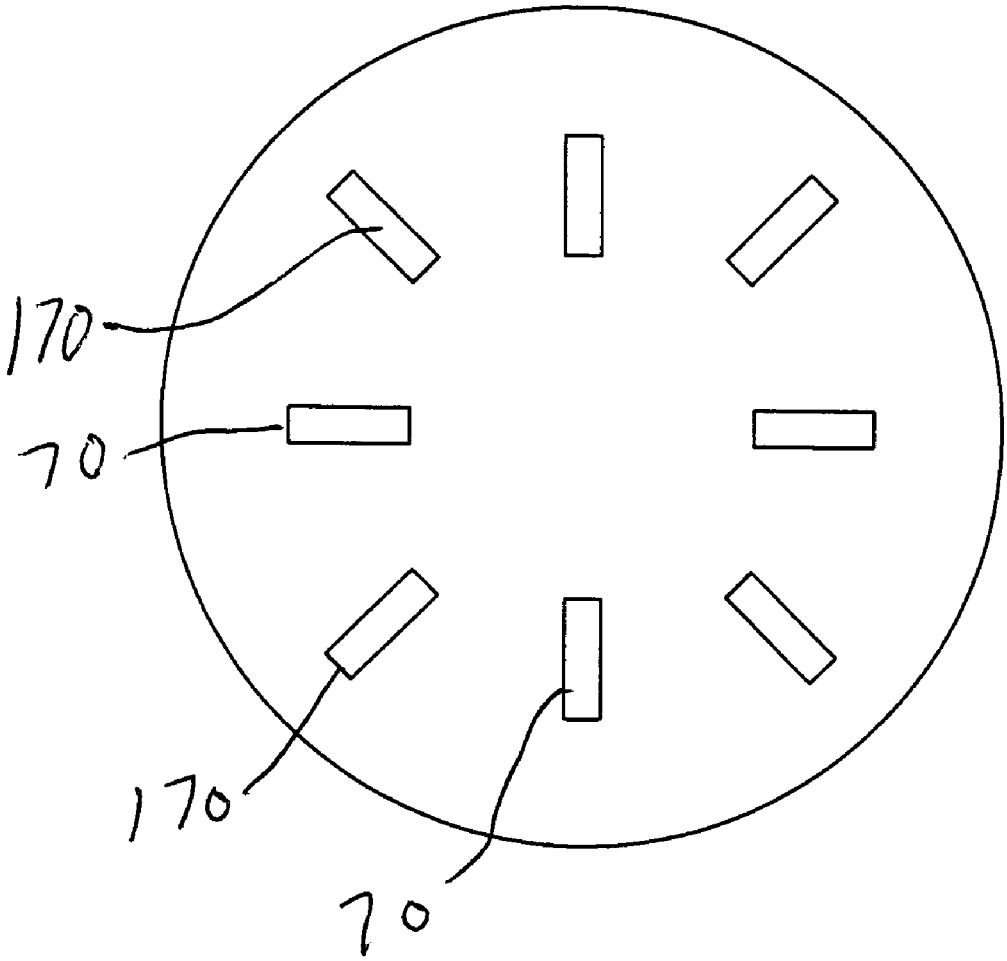
FIG. 8 is a view of the support member showing arrangement of the coil springs thereon.

For example, referring to FIGS. 5, 6, and 7 where like features of FIGS. 1–4 are represented by like reference numerals, a second thermal baffle member 160 is shown disposed on support ring 158 for positioning along with thermal baffle member 60 at the lower end of the casting furnace. The second thermal baffle member 160 is guided for up and down movement on guide rods 156 attached at their lower ends to support plate 152. Support plate 152 is movable up and down relative to support plate 52 in response to movement of ram 28 to position the first and second thermal baffle members 60, 160 at the lower end of the casting furnace 28 as shown in FIG. 6. The plate 152 includes apertures 152*a* and 152*b* through the springs elements 70*b* of springs 70 and guide rods 56 can pass. A plurality of coil springs 170 that are similar to springs 70 described above are attached via plate 71 to the underside of the chill plate 26 and include spring elements 170*b* that extend to and are attached to the support plate 152.

When the melt-filled mold 20 is withdrawn from the casting furnace by lowering of the ram 28 to effect directional solidification of the melt, FIG. 7, the coil spring elements 70*b* continue to bias and retain the support ring 58 of thermal baffle member 60 against the support ring 30 of the lower end of the casting furnace as they are coiled or retracted back into the respective housing 70*a*. The coil spring elements 170*b* continue to bias and retain the thermal baffle member 160 against the biased support ring 58 and adjacent the first thermal baffle member 60 as they are coiled or retracted back into the respective housing 170*a*. The second thermal baffle member 160 has an inner opening 160*a* closely contoured to the airfoil region A of the mold 20 while thermal baffle 60 has opening 60*a* closely spaced to the platform region P of the mold 20 for thermal baffle purposes. Coil spring elements 70*b*, 170*b* continue to exert an upward bias on the thermal baffle members 60, 160 during withdrawal of the airfoil region A of the mold 20 until the platform region P thereof engages the thermal baffle member 160, FIG. 7, carries it downward against the bias of springs 170. The thermal baffle member 60 remains biased and retained against the support ring of the lower end of the casting furnace as the ram is lowered until the coil spring elements are fully retracted, at which time further lowering of the ram 28 will disengage the thermal baffle member 60 from the lower end of the casting furnace as described above with respect to FIG. 1. The ram 28 is lowered to move the thermal baffle members 60, 160 and their supporting components to the remote position relative to the lower end of the casting furnace.

At this remote position, one or both of the thermal baffle members can removed and replaced if a series or run of molds 20 having a different exterior shape are to be cast next. In particular, new thermal baffle members 60, 160 unique to the new mold exterior shape is fastened on the support rings 58, 158 for use in casting the next series or run of molds. The thermal baffle members 60, 160 can be readily replaced with other thermal baffle members between each run of molds without having to cool down and disassemble the casting furnace to effect thermal baffle replacement. The new thermal baffles member would have an openings 60*a*, 160*a* optimized in shape for the new exterior shape of the next series or run of molds to be cast. Thermal shielding action between the hot casting furnace 11 and cooling region CR below the casting furnace is thereby optimized for each particular shape of one or series or run of mold(s) to be cast.

Also, at this remote position, the thermal baffle members 60, 160 may be inspected for damage and replaced if necessary.

It is to be understood that the invention has been described with respect to certain specific embodiments thereof for purposes of illustration and not limitation. The present invention envisions that modifications, changes, and the like can be made therein without departing from the spirit and scope of the invention as set forth in the following claims.

We claim:

1. Directional solidification casting apparatus, comprising a casting furnace having an open lower end through which a mold disposed on a chill member is moved by a ram, a thermal baffle member supported on said ram and positionable at said lower end of said casting furnace by movement of said ram toward said casting furnace, and spring means for retaining said thermal baffle member at said lower end as said ram positions said mold in said casting furnace and as said ram withdraws said mold filled with molten metallic material away from said casting furnace for directional solidification of said molten metallic material in said mold.

2. The apparatus of claim 1 wherein said ram carries a chill member on which said mold is disposed.

3. The apparatus of claim 2 including a support member disposed on said ram for movement therewith as said mold is placed in and then withdrawn from said casting furnace.

4. The apparatus of claim 3 including a plurality of upstanding support elements disposed on said support member, said upstanding support elements supporting, proximate their upper ends, said thermal baffle member.

5. The apparatus of claim 3 wherein said spring means is disposed between said chill member and said support member.

6. The apparatus of claim 5 wherein said spring means comprises one or more coil springs having a housing fixed on an underside of the chill member and a movable coil spring element having one end connected to said housing another end that is connected to said support member.

7. The apparatus of claim 1 including a second thermal baffle member positionable at said lower end of the casting furnace adjacent said thermal baffle member and spring means for retaining the second thermal baffle member at said lower end as said ram withdraws said mold filled with molten metallic material away from said casting furnace for directional solidification of said molten metallic material in said mold.

8. The apparatus of claim 7 wherein the second thermal baffle member includes an opening for movement of the mold therethrough and having a configuration different from an opening in said thermal baffle member for movement of the mold therethrough.

9. A method of directional solidification of a molten metallic material in a mold, comprising moving a ram on which said mold is disposed toward an open lower end of a casting furnace, carrying a thermal baffle member on said ram as it moves toward said lower end to position said thermal baffle member at said lower end, continuing moving said ram relative to said thermal baffle member at said lower end to place said mold in said casting furnace, providing a molten metallic material in said mold, and withdrawing said mold filled with said molten metallic material from casting furnace for directional solidification of said molten metallic material in said mold while spring means biases said thermal baffle member in a direction toward said lower end to retain it at said lower end.

10. The method of claim 9 including disposing said mold on a chill member on said ram.

11. The method of claim 9 including disposing said spring means between said chill member and said support member to maintain said bias on said thermal baffle member.

12. The method of claim 11 wherein said spring means comprises one or more coil springs having a housing fixed on an underside of the chill member and a movable coil spring element having one end connected to said housing another end that is connected to said support member.

13. The method of claim 12 including continuing to bias the thermal baffle member against said lower end until each said coil spring means is retracted.

14. The method of claim 13 including further lowering said ram to disengage said thermal baffle member from said lower end.

15. The method of claim 14 including replacing said thermal baffle member with another new thermal baffle member.

16. The method of claim 9 including moving a second thermal baffle member as said ram moves toward said lower end to position said second thermal baffle member at said lower end adjacent said thermal baffle.

17. The method of claim 16 including spring biasing the second thermal baffle member in a direction toward the lower end of the casting furnace as the mold is withdrawn from the casting furnace.

18. The method of claim 17 including engaging the mold with the second thermal baffle member as the mold is withdrawn so as to move the second thermal baffle member away from the lower end of the casting furnace.

* * * * *